US006719523B2

(12) United States Patent
Staroselsky et al.

(10) Patent No.: US 6,719,523 B2
(45) Date of Patent: Apr. 13, 2004

(54) METHOD AND APPARATUS FOR STEAM TURBINE SPEED CONTROL

(75) Inventors: Naum Staroselsky, West Des Moines, IA (US); Mykhailo Volynskyi, Moscow (RU); Dmitry Drob, West Des Moines, IA (US)

(73) Assignee: Compressor Controls Corporation, Des Moines, IA (US)

( * ) Notice: Subject to any disclaimer, the term of this patent is extended or adjusted under 35 U.S.C. 154(b) by 134 days.

(21) Appl. No.: 10/002,924

(22) Filed: Nov. 15, 2001

(65) Prior Publication Data

US 2003/0091429 A1 May 15, 2003

(51) Int. Cl.[7] ..... F01D 17/20
(52) U.S. Cl. ..... 415/1; 415/30
(58) Field of Search ..... 415/1, 13, 15, 415/30

(56) References Cited

U.S. PATENT DOCUMENTS 4,007,906 A * 2/1977 Karpenko ..... 251/26
5,295,783 A * 3/1994 Lesko et al. ..... 415/30

FOREIGN PATENT DOCUMENTS

| | | |
|---|---|---|
| DE | 129667 | 6/1969 |
| DE | 2712349 | 3/1980 |
| DE | 2833277 | 11/1980 |
| EP | 0063360 | 10/1982 |
| SU | 1132031 | 12/1984 |
| SU | 1393909 | 5/1988 |

* cited by examiner

*Primary Examiner*—Edward K. Look
*Assistant Examiner*—Kimya N. McCoy
(74) *Attorney, Agent, or Firm*—Sturm & Fix LLP

(57) ABSTRACT

Steam turbine speed-control systems often incorporate pilot valves for the purpose of controlling the position of hydraulic actuators for steam valves. However, the operational efficiency of these pilot valves can suffer from imperfections due to manufacturing defects, wear, and the like, thereby impairing the control system's overall performance. For these reasons, this disclosure relates to a method for overcoming a faulty pilot valve by incorporating a control system (including additional controllers) dedicated to the pilot valve. In this type setup, not only can the position of the pilot valve be a control variable, but the velocity of actuation of this valve can also be used as another control variable. Therefore, the results of separate controllers, using these two control variables, can be combined to improve the dynamic response of the steam turbine speed-control system.

14 Claims, 2 Drawing Sheets

METHOD AND APPARATUS FOR STEAM TURBINE SPEED CONTROL

TECHNICAL FIELD

This invention relates generally to a method and apparatus for speed control of steam turbines. More specifically, the invention relates to a method for overcoming performance degradation of a worn or defective pilot-valve assembly (a component of the control system) by employing one or more additional, digital controllers; thus improving the overall accuracy of the turbine speed-control system.

BACKGROUND ART

To govern the speed and power of a steam turbine, a valve (or more commonly, a set of valves) must be adjusted to vary the flow of steam through the turbine. Typically, such valves are regulated with a hydraulic steam-valve actuator which, in turn, is activated by way of a pilot valve modulated by an electromechanical actuator that receives its signal from a speed-control system.

Present-day speed control systems for steam turbines include a proportional-integral-differential (PID) controller that utilizes signals representing rotational speed. This speed controller then transmits an actuator-position set point to another PID controller that monitors steam-valve actuator position and whose output activates (indirectly) the steam-valve actuator to render its position equal to the actuator set point. In reality, the steam-valve actuator controller's output is employed as a set point for an electromechanical actuator which modulates a pilot valve: hydraulic fluid is directed through the pilot valve to-and-from the steam-valve actuator to change its position. Pilot valves can, however, suffer performance degradation due to manufacturing defects, wear, and other ills, thereby impairing system performance. Consequently, a method of control that compensates for faulty pilot valves is needed.

DISCLOSURE OF THE INVENTION

A purpose of this invention is to provide a method for controlling the rate of steam flow through a steam turbine by monitoring the position of a pilot valve along with the dynamics of a steam valve, and using this information to compensate for the action of a faulty pilot-valve assembly that does not perform to standard.

To accomplish this purpose, control elements are added to the standard control system used to govern turbine speed. In particular, one or two additional PID controllers are included. One of these units is dedicated to maintaining the position of the pilot valve at a set point obtained from a PID steam-valve actuator position controller. Therefore, the controller for pilot-valve position is cascaded with the controller for steam-valve position.

A second controller is dedicated to steam-valve actuator velocity. For that reason, a calculation function is required, which takes the first time-derivative of the steam-valve position signal. And the set point for this controller is proportional to the difference (error) between the steam-valve position set point and its actual position.

The resulting signal, inputted to the pilot-valve's electromechanical actuator, is proportional to a linear combination of the outputs from the two additional PID controllers.

BEST MODE FOR CARRYING OUT THE INVENTION

To maintain accurate and stable speed-control of a steam turbine, the control system must be capable of compensating for possible faulty operation of a pilot-valve assembly by monitoring and controlling both the position of a pilot valve and the velocity of a steam-valve actuator.

Figure 1:
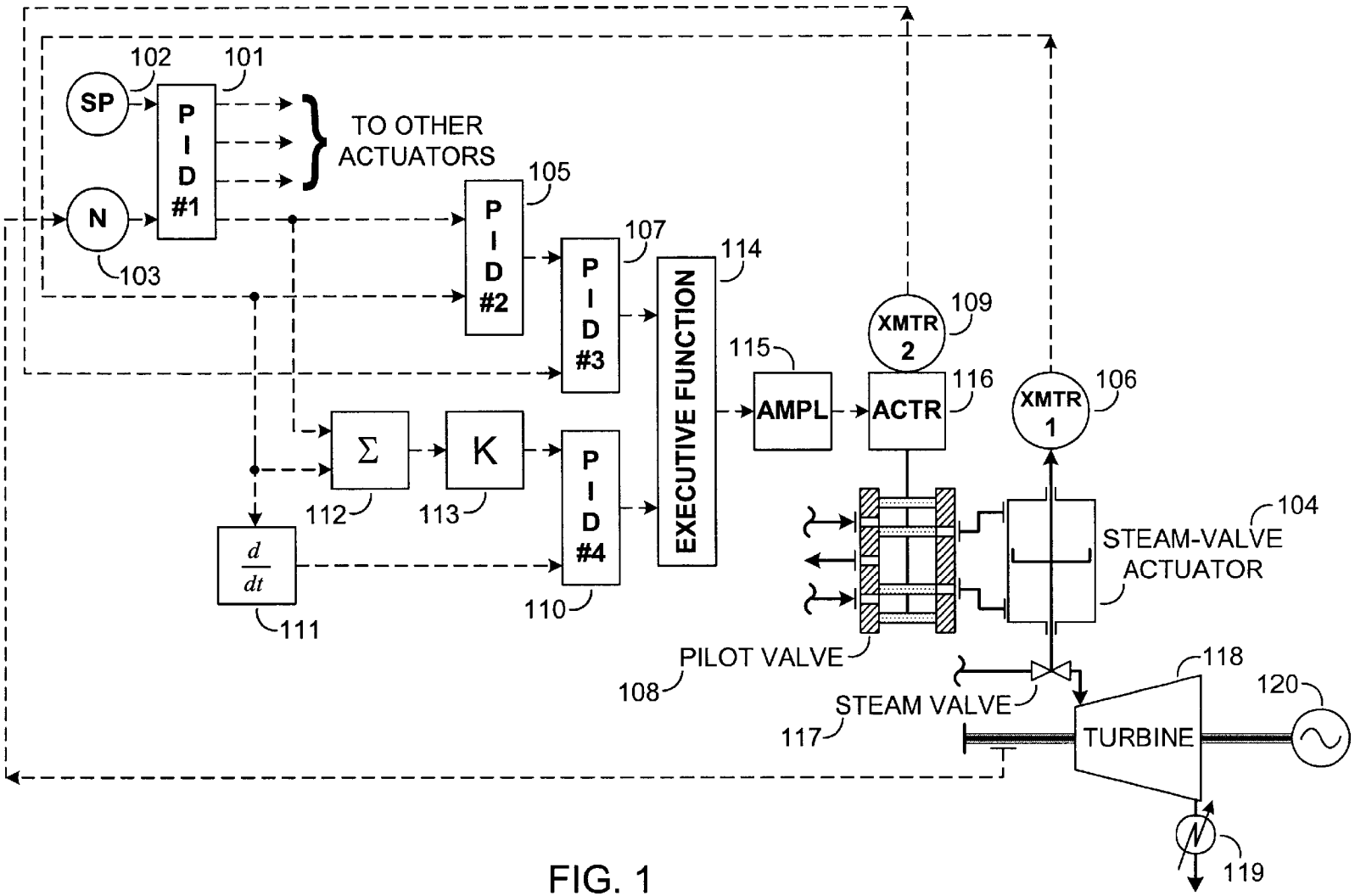
FIG. 1 shows a steam turbine with its speed-control system.

FIG. 1 shows a steam turbine complete with its speed-control system, which incorporates a rotational-speed PID controller number one 101 that monitors a speed set point (SP) 102, in addition to comparing and computing rotational-speed measurements obtained by a speed transmitter (N) 103. The output of this controller 101 is a set point (for a steam-valve actuator 104) used in a steam-valve actuator position PID controller number two 105, which also monitors actual steam-valve actuator position by way of a transmitter (XMTR 1) 106 and causes the actuator's position to match the actuator set point. For the invention to accomplish this task, the output of controller number two 105 is a pilot-valve position set point inputted to an additional PID controller number three 107 designed to monitor the current position of the pilot valve 108 by way of a transmitter (XMTR 2) 109, as well as its set point. The output of controller number three 107 is directed to reduce the difference between the pilot valve's position and its set point to zero.

Another supplementary PID controller number four 110 is intended to govern steam-valve actuator velocity. An input to this controller emanates from a function block (d/dt) 111, which calculates steam-valve velocity from the measured values of the actuator's 104 position, as reported by its transmitter 106. The set point for controller number four 110 is determined by a summation (Σ) block 112 and by a constant multiplier (K) block 113, and it (the velocity set point) is proportional to the error between the steam valve's position and its position set point. Specifically, the set point is $$\frac{X_{sv} - SP_{sv}}{\Delta t_a}$$

where XSV is the actuator's instantaneous position; $SP_{SV}$ is the actuator's set point; and $\Delta t_a$ is the time constant of the actuator.

Figure 2:
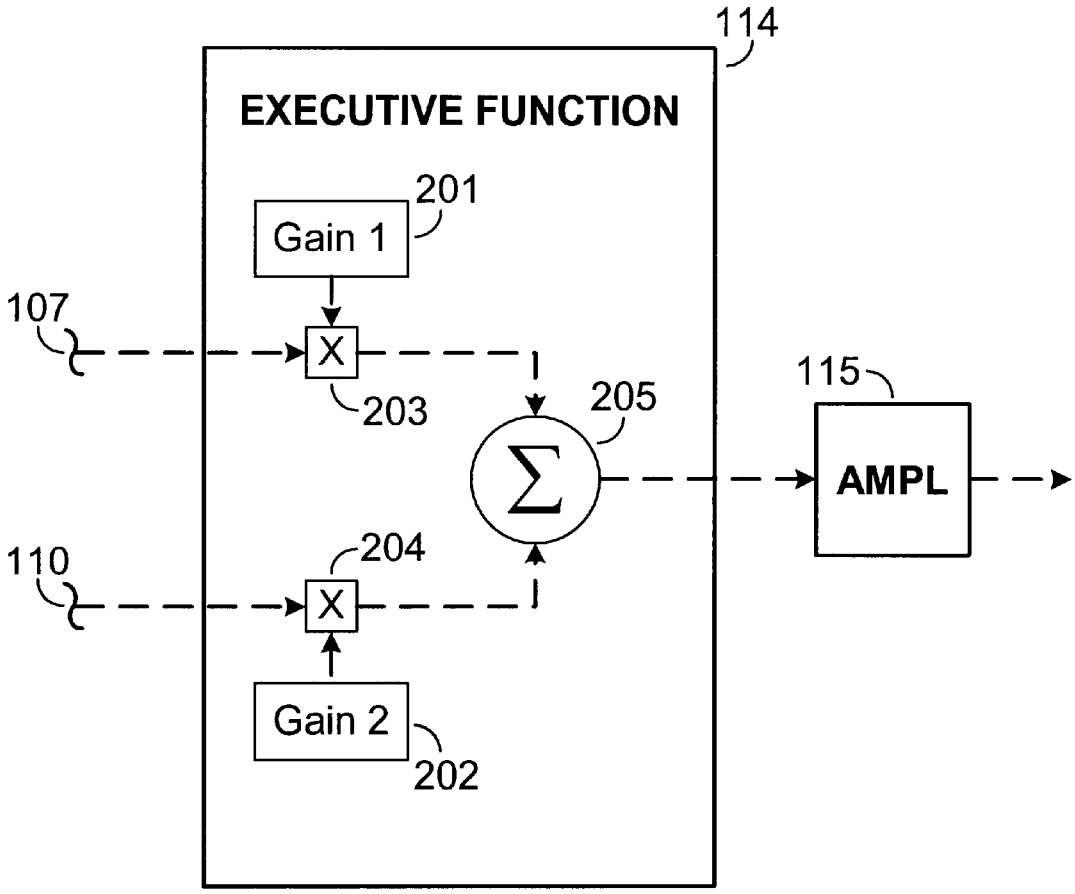
FIG. 2 shows an Executive Function.

The outputs of controllers number three 107 and number four 110 are then used by an executive function 114 whose purpose is to combine these two signals into one output signal (see FIG. 2), which is accomplished (in one embodiment) by calculating a weighted sum of the two outputs 107, 110. Weightings (or gains) 201, 202 serve to emphasize, or de-emphasize, the respective contributions of each output to the resulting control action.

Gain one 201 is acted on by the output from controller number three 107 in a multiplication block 203; while Gain 2 202 is acted on by the output from controller number four 110 in a second multiplication block 204; these two products are then summed 205. Other embodiments for the executive function 114 are possible; the main goal is to accomplish satisfactory combination of the two signals: pilot-valve position 107 and steam-valve actuator velocity 110.

Gains one 201 and two 202 can be fixed by an operator or technician, or they could be functions of the magnitude of errors in controllers number three 107 and number four 110. Gains could also be a function of the regime in which the steam turbine is operating.

The output of the executive function 114 enters a signal amplifier (AMPL) 115, and from there it enters an electromechanical actuator (ACTR) 116 that modulates the pilot valve 108 which, by way of hydraulic fluid, activates the steam-valve actuator 104 causing a change in its position. The steam-valve actuator 104 is connected to one or more steam valves (represented in FIG. 1 as a single valve 117) used to regulate the flow rate of steam passing through a turbine 118. When steam exits the turbine, it passes into a condenser 119 or other process; additionally, the turbine is used to drive a load 120 (shown in FIG. 1 as a generator), but this invention is not restricted to a particular load.

Obviously many modifications and variations of the present invention are possible in light of the above teachings. It is, therefore, to be understood that within the scope of the appended claims, the invention may be practiced otherwise than as specifically described.

We claim:

1. A method for controlling steam flow-rate through a steam turbine using a control system comprising a controller for steam-turbine speed to generate a steam-valve actuator set point, a pilot valve directing hydraulic fluid flow to-and-from a steam-valve actuator, a transmitter sending a signal proportional to a steam-valve actuator position, and an additional controller for a pilot-valve position, the method comprising:

(a) calculating a first value proportional to a difference between the steam-valve actuator set point and the steam-valve actuator position;

(b) calculating a second value equal to a first time-derivative of the steam-valve actuator position as a control variable for the pilot-valve controller;

(c) calculating a position signal within the pilot-valve controller based upon the first and second values; and (d) positioning a pilot-valve actuator based upon the position signal of the pilot-valve controller.

2. A The method of claim 1, wherein calculating a first value uses a constant of proportionality equal to a time constant for the steam-valve actuator.

3. The method as in claim 1 wherein the pilot-valve actuator is an electromechanical device.

4. A method for controlling steam flow-rate through a steam turbine using a control system comprising a controller for a steam-valve actuator position, a pilot-valve directing hydraulic fluid flow to-and-from a steam-valve actuator, a transmitter sending a signal proportional to a pilot-valve position, an additional controller for the pilot-valve position, and a supplementary controller is for steam-valve actuator velocity, the method comprising:

(a) sending a position set point from the steam-valve actuator controller to the pilot-valve controller;

(b) sending a position signal from the pilot-valve transmitter to the pilot-valve controller;

(c) calculating a position signal within the pilot-valve controller;

(d) positioning a pilot-valve actuator based upon the pilot-valve position signal;

(e) calculating a first value proportional to a difference between a steam- valve actuator position and a steam-valve actuator set point as a set point for the actuator velocity controller;

(f) calculating a second value equal to a first time-derivative of the steam- valve actuator position as a control variable for the actuator velocity controller;

(g) calculating an additional pilot-valve position signal within the actuator velocity controller based upon the first and second values; and (h) positioning a pilot-valve actuator based upon the pilot-valve position signal and the additional pilot valve position signal.

5. The method of claim 4, wherein the pilot-valve actuator is positioned based upon a linear combination of the first and second, pilot-valve position signals.

6. The method as in claim 4 wherein the pilot-valve actuator is an electromechanical device.

7. The method as in claim 4, wherein the pilot-valve actuator is an electromechanical device.

8. An apparatus for controlling steam flow-rate through a steam turbine using a control system comprising a controller for steam-turbine speed to generate a steam-valve actuator set point, a pilot valve directing hydraulic fluid flow to-and-from a steam-valve actuator, a transmitter sending a signal proportional to a steam-valve actuator position, and an additional controller for a pilot-valve position, the apparatus comprising:

(a) means for calculating a first value proportional to a difference between the steam-valve actuator set point and the steam-valve actuator position;

(b) means for calculating a second value equal to a first time-derivative of the steam-valve actuator position as a control variable for the pilot-valve controller;

(c) means for calculating a position signal within the pilot-valve controller based upon the first and second values; and (d) means for positioning a pilot-valve actuator based upon the position signal of the pilot-valve controller.

9. The apparatus of claim 8, wherein calculating a first value uses a constant of proportionality equal to a time constant for the steam-valve actuator.

10. The apparatus as in claim 8, wherein the pilot-valve actuator is an electromechanical device.

11. An apparatus for controlling steam flow-rate through a steam turbine using a control system comprising a controller for a steam-valve actuator position, a pilot-valve directing hydraulic fluid flow to-and-from a steam-valve actuator, a transmitter sending a signal proportional to a pilot-valve position, and a supplementary controller for steam-valve actuator velocity, the apparatus comprising:

(a) means for sending a position set point from the steam-valve actuator controller to the pilot-valve controller (b) means for sending a position signal from the pilot-valve transmitter to the pilot-valve controller;

(c) means for calculating a position signal within the pilot-valve controler;

(d) means for positioning a pilot-valve actuator based upon the pilot-valve position signal;

(e) means for calculating a first value proportional to a difference between a steam- valve actuator position and a steam-valve actuator set point as a set point for the actuator velocity controller;

(f) means for calculating a second value equal to a first time-derivative of the steam-valve actuator position as a control variable for the actuator velocity controller;

(g) means for calculating an additional pilot-valve position signal within the actuator velocity controller based upon the first and second values; and (h) means for positioning a pilot-valve actuator based upon the pilot-valve position signal and the additional pilot valve position signal.

12. The apparatus of claim 11, wherein the pilot-valve actuator is positioned based upon a linear combination of the first and second, pilot-valve position signals.

13. The apparatus as in claim 11, wherein the pilot-valve actuator is an electromechanical device.

14. The apparatus as in claim 11 wherein the pilot-valve actuator is an electromechanical device.

* * * * *